US005649524A

United States Patent [19]

Pullin

[11] Patent Number: 5,649,524

[45] Date of Patent: Jul. 22, 1997

[54] ARCHERY BOW TENSIONING DEVICE

[76] Inventor: David L. Pullin, P.O. Box 3132, Staunton, Va. 24403-3132

[21] Appl. No.: 670,022

[22] Filed: Jun. 25, 1996

[51] Int. Cl.[6] ..... F41B 5/18

[52] U.S. Cl. ..... 124/86; 124/35.2

[58] Field of Search ..... 124/23.1, 24.1, 124/35.2, 86, 88

[56] References Cited

U.S. PATENT DOCUMENTS

| | | | |
|---|---|---|---|
| 1,210,332 | 12/1916 | Kvistad | 124/23.1 |
| 2,815,016 | 12/1957 | Kellogg | 124/35.2 |
| 3,561,418 | 2/1971 | Fredrickson | 124/24.1 |
| 3,895,621 | 7/1975 | Kellogg | 124/24.1 |
| 4,615,326 | 10/1986 | Rathbun | 124/88 |
| 4,711,228 | 12/1987 | Gillespie | 124/25 |
| 4,721,092 | 1/1988 | Waiser | 124/40 |
| 4,919,107 | 4/1990 | Bunts | 124/86 X |
| 5,000,154 | 3/1991 | Slayton | 124/23.1 |
| 5,002,035 | 3/1991 | Brooks | 124/23.1 |
| 5,009,214 | 4/1991 | Wilde | 124/35.2 |
| 5,065,730 | 11/1991 | Kluver | 124/35.2 |
| 5,390,652 | 2/1995 | Perkins | 124/24.1 |
| 5,425,351 | 6/1995 | Kozitka | 124/88 |
| 5,465,705 | 11/1995 | Baeseman | 124/88 |

*Primary Examiner*—John A. Ricci
*Attorney, Agent, or Firm*—Brady, O'Boyle & Gates

[57] ABSTRACT

An archery bow tensioning device for holding a bowstring in a fully drawn position wherein one end of a rod is freely received in and releasable from a blind bore provided in the bow handle, and the opposite end of the rod is provided with a trigger mechanism having a safety catch.

7 Claims, 10 Drawing Sheets

ARCHERY BOW TENSIONING DEVICE

BACKGROUND OF THE INVENTION

The manual holding of a bowstring at a full draw readiness state with an arrow supported between the rest on the bow handle and its nock notched on the bowstring requires great strength on the part of the archer or bowman, particularly, if held in this state for any appreciable length of time resulting in the archer becoming weary, thereby affecting the accuracy of the arrow being shot. This is particularly true when the bow is a compound bow.

To overcome this problem, it has been proposed to fixedly mount one end of a stabilizing or tension bar to the bow handle and to provide the opposite end of the bar with a trigger mechanism for releasably holding the bowstring in the fully drawn position. This relieves the archer from manually holding the bowstring while aiming the arrow.

While these proposed stabilizing bars and associated triggers have been satisfactory for their intended purpose, they have been characterized by certain disadvantages in that the bars are permanently attached to the bow handles resulting in the bows being bulky and cumbersome, and therefore not readily storable.

After considerable research and experimentation, the tension device of the present invention has been devised which is freely mounted on the bow handle and releasable therefrom after the arrow has been shot; the conventional trigger mechanism has also been improved by providing a safety catch.

SUMMARY OF THE INVENTION

The tensioning device of the present invention comprises, essentially, a rod having one end adapted to be freely received within a recessed blind bore provided in the bow handle. The opposite end of the rod is provided with a trigger mechanism having a safety latch to prevent the inadvertent shooting of an arrow. If the bow handle is made of metal, the recessed blind bore is provided by drilling a bore into the handle of the bow. If the bow is made of wood, a fitting having a recessed blind bore is threadably mounted in the handle. By this construction and arrangement, various types of bows can be retrofitted to accommodate the tensioning device of the present invention.

DESCRIPTION OF THE PREFERRED EMBODIMENTS

Figure 1:
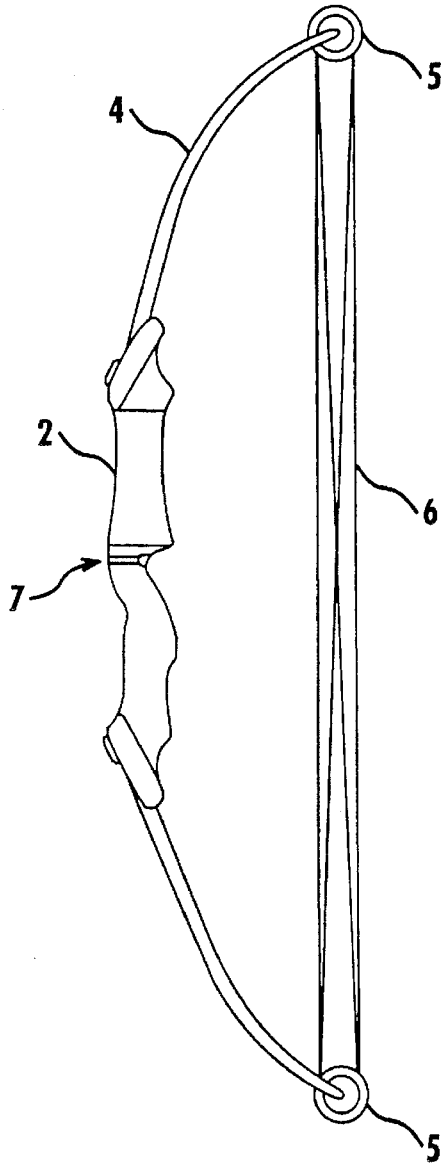
FIG. 1 is a side elevational view of one embodiment of a bow having a recessed blind bore in the handle.

Referring to the drawings and, more particularly to FIG. 1, a conventional compound bow 1 is shown having a rigid handle 2 having an arrow rest 3 on one side thereof and a pair of spring-like metal arms 4 attached to the ends thereof. A pulley assembly 5 is mounted on the distal end of each arm 4, and a bowstring 6 is reeved between the pulley assemblies 5.

Figure 2:
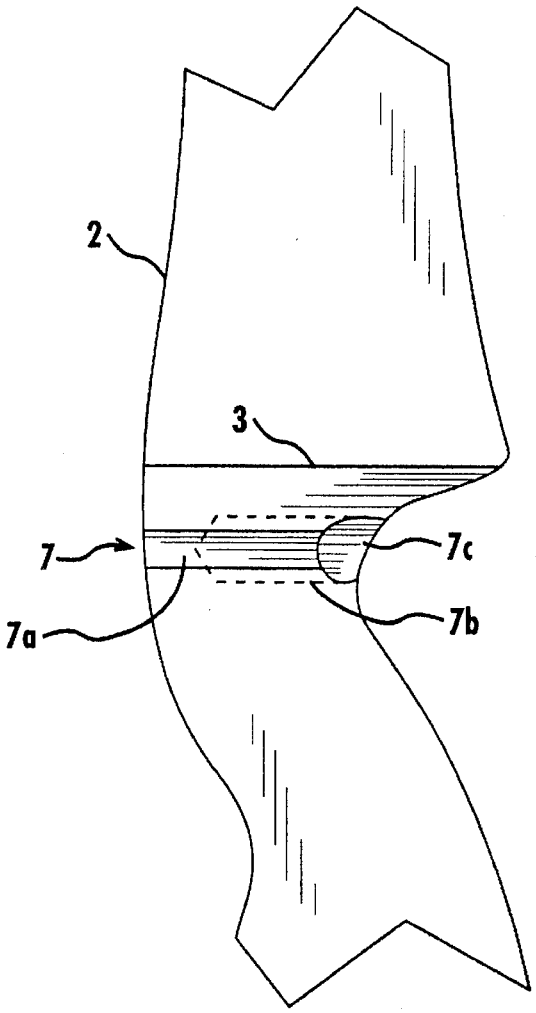
FIG. 2 is an enlarged fragmentary view of the portion of the handle shown in FIG. 1 containing the recessed blind bore.
Figure 3:
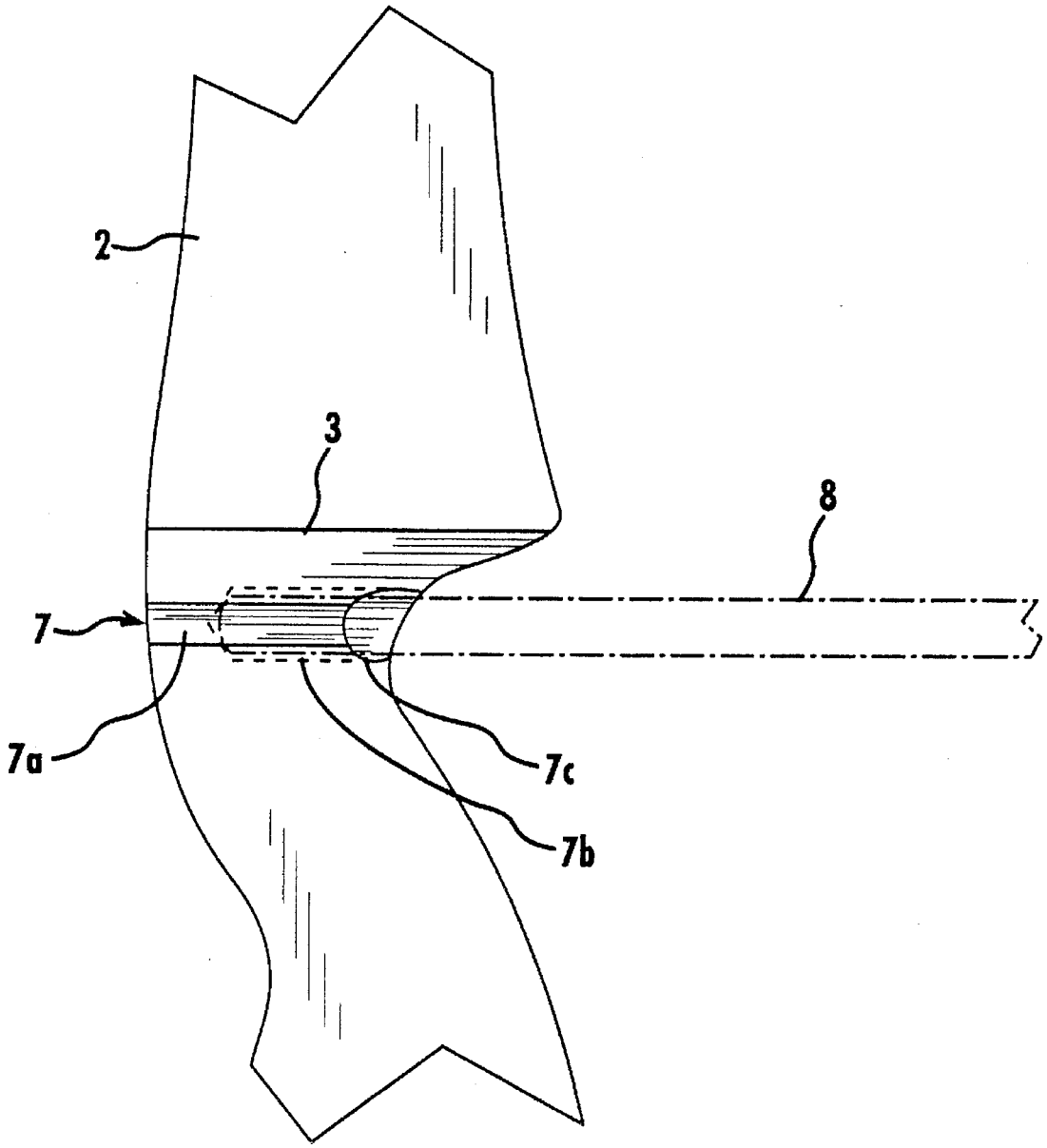
FIG. 3 is an enlarged fragmentary view of the portion of the handle of FIG. 2, showing in phantom, the end of a tensioning device inserted into the recessed blind bore.
Figure 4:
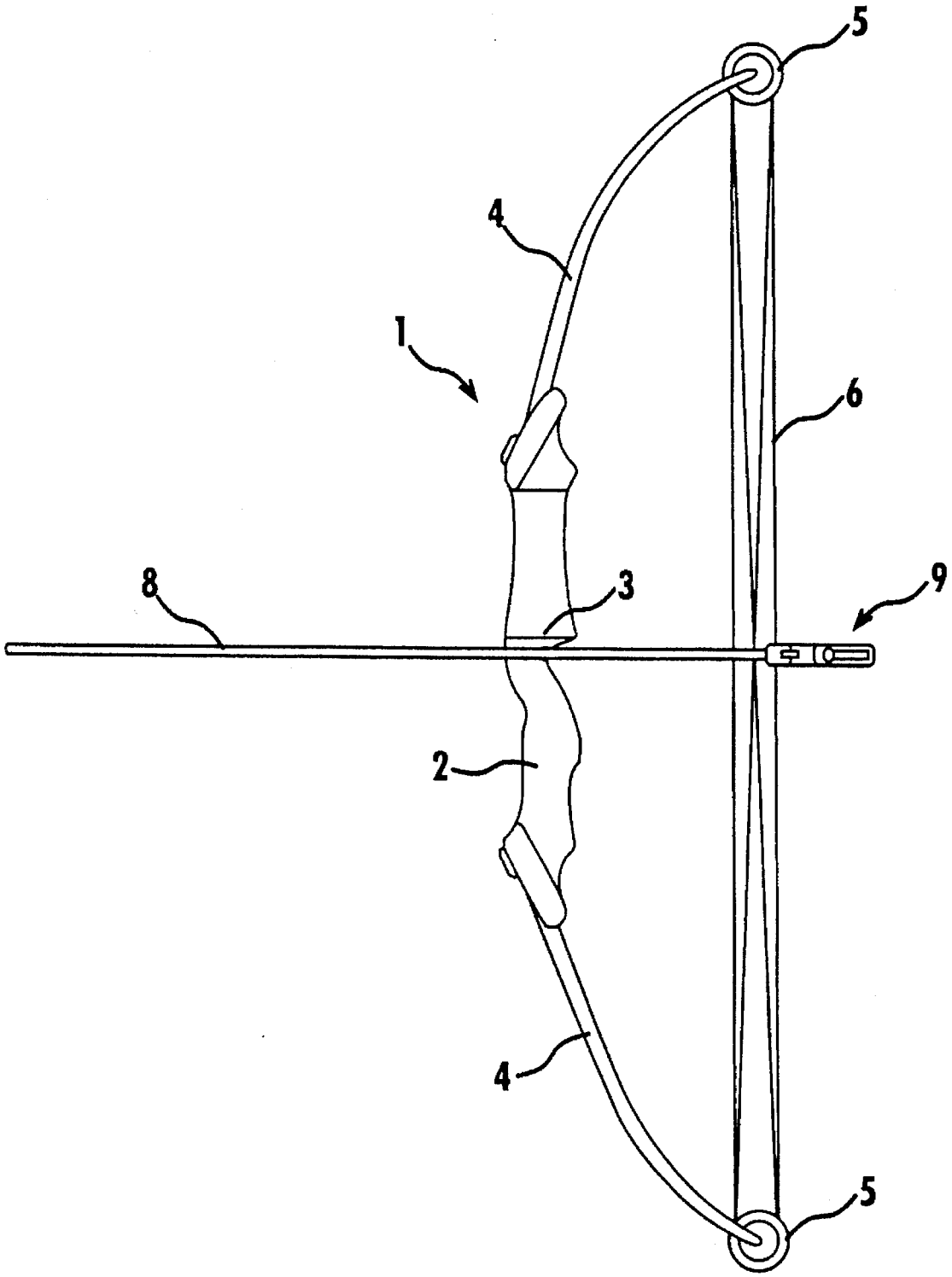
FIG. 4 is a side elevational view of the tensioning device of the present invention being placed on the bow of FIG. 1.

As will be seen in FIGS. 1 and 2, the handle 2 is provided with a recessed blind bore 7 positioned below the arrow rest 3. The recessed blind bore 7 comprises a recess 7*a* formed in the side of the handle 2 and a blind hole 7 drilled into the handle. One end of the recess 7*a* communicates with the entrance to the blind hole 7*b* as at 7*c*. The recessed blind bore 7 is adapted to receive the distal or free end of a rod, as shown in FIG. 3, having a trigger mechanism 9 at the opposite or proximate end of the rod 8, as shown in FIG. 4.

Figure 5:
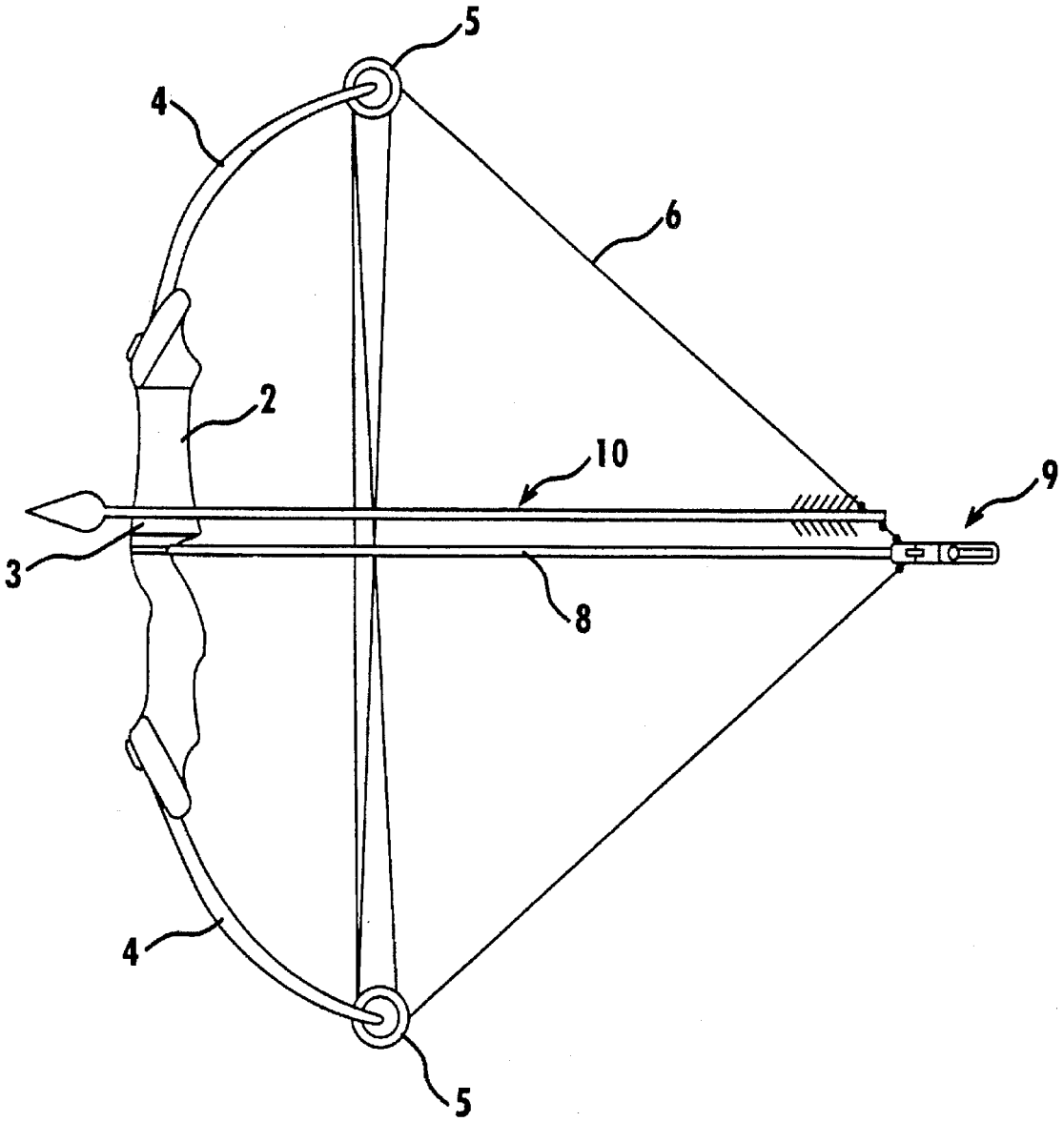
FIG. 5 is a side elevational view of the bow shown in FIG. 4 illustrating the tensioning device in the operative position.

To mount the rod 8 on the handle 2, the bowstring 6 is latched to the trigger mechanism 9. The trigger mechanism 9 and associated bowstring 6 and rod are then pulled rearwardly, or in a direction away from the handle 2. During this rearward movement, the distal end of the rod 8 slides along the recess 7*a* until the end thereof reaches the entrance 7*c* to the blind bore 7, whereupon the end of the rod 8 is allowed to drop into the blind bore 7. The bow 1 is now cocked, as shown in FIG. 5, to allow the placement of an arrow 10 in the operative position thereon. By using the rod 8 trigger mechanism, there is no strain on the archer to maintain the bowstring 6 in the full draw readiness state. When the trigger mechanism 9 is activated, the bowstring 6 is released to propel the arrow 10, and the rod 8 is readily released from the blind bore 7.

While the recessed blind bore 7 shown in FIGS. 1 to 5 is drilled into the bow handle 2, there are some bow handles made from material, such as wood, which might split if recessed and drilled. That problem is overcome, as shown in FIGS. 6 to 9, by employing a fitting 11 threaded into the side of the handle 2. The fitting 11 comprises a head portion 11*a* having a recess 11*b* formed in a face thereof communicating with the entrance 11*c* of a blind bore 11*d* drilled into the head portion 11*a* and extending parallel to the recess 11*b*. The head portion 11*a* is provided with an integral threaded bolt 11*e* having a lock nut 11*f*. By this construction and arrangement, the fitting 11 can be threaded into a topped hole provided in the side of the bow handle 2.

Figure 6:
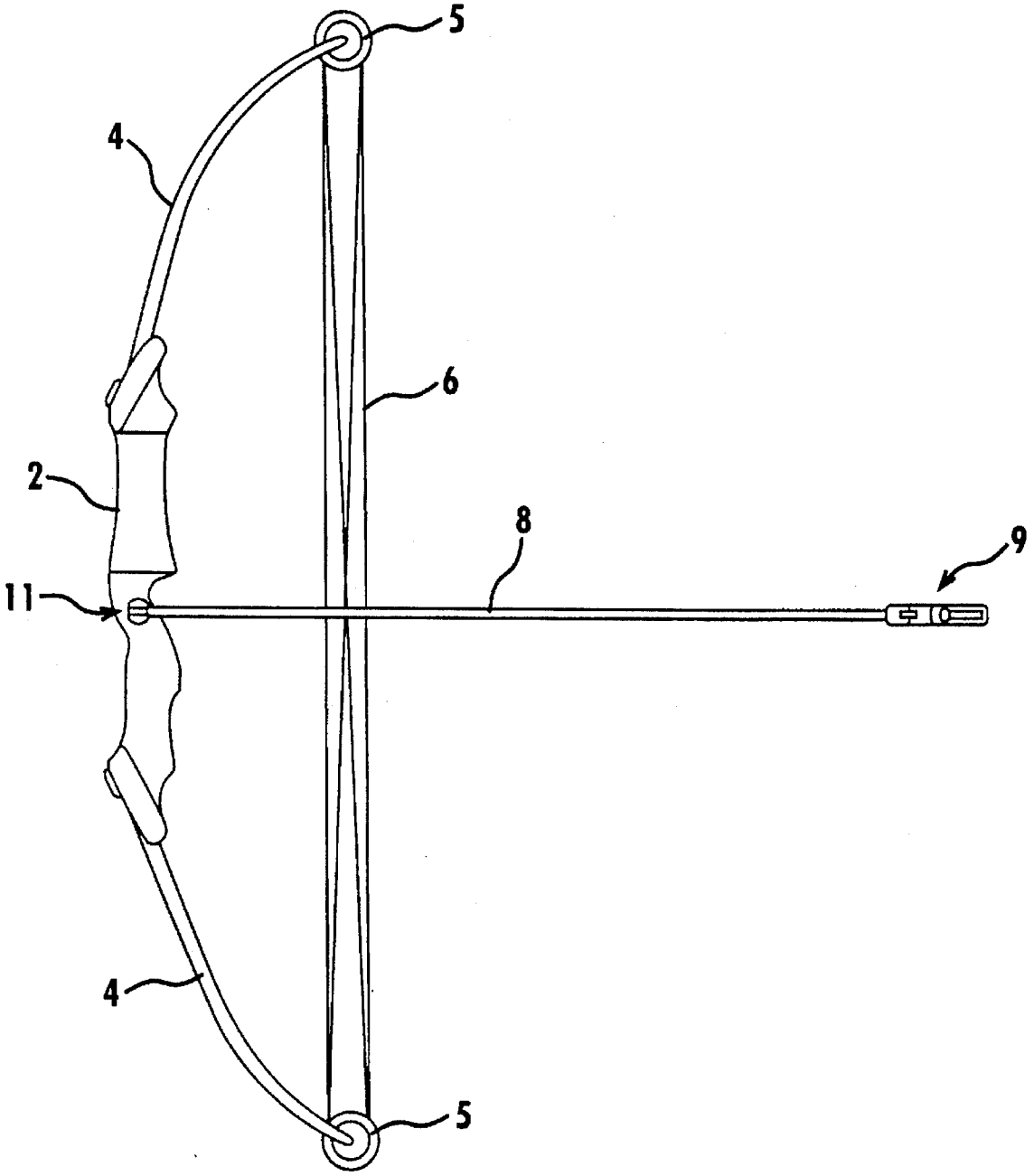
FIG. 6 is a side elevational view of the bow shown in FIG. 1 having a fitting provided with a recessed blind bore secured to a side of the bow handle.
Figure 7:
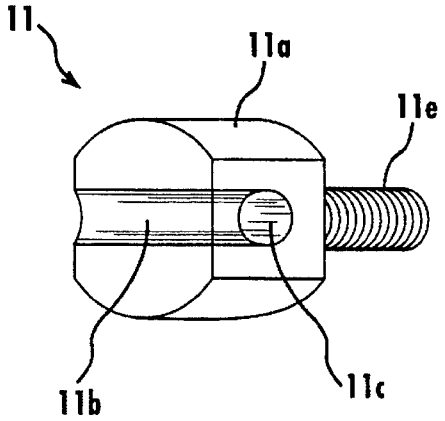
FIG. 7 is a perspective view of the fitting shown in FIG. 6.
Figure 8:
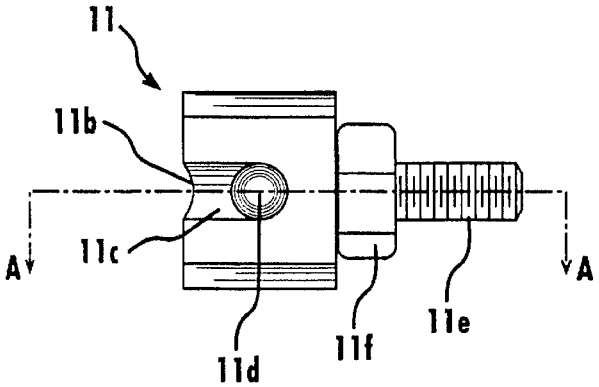
FIG. 8 is a side elevational view of the fitting shown in FIG. 7.
Figure 9:
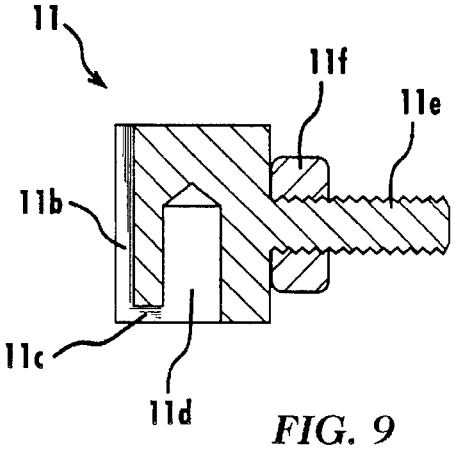
FIG. 9 is a view taken along line 9—9 of FIG. 8.
Figure 10:
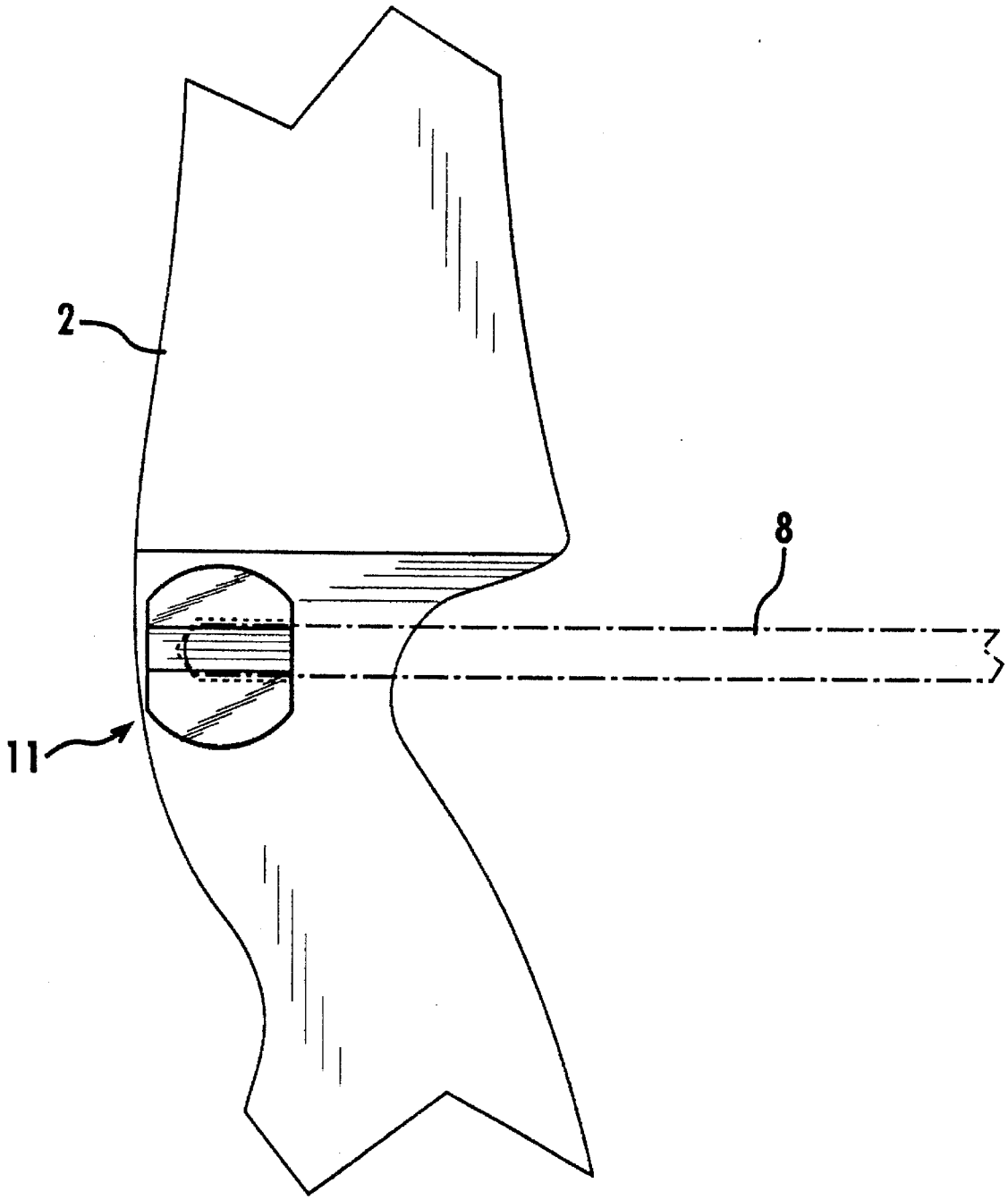
FIG. 10 is an enlarged fragmentary view of a portion of the handle shown in FIG. 6, showing in phantom, the end of the tensioning device inserted into the recessed blind bore provided in the fitting.
Figure 11:
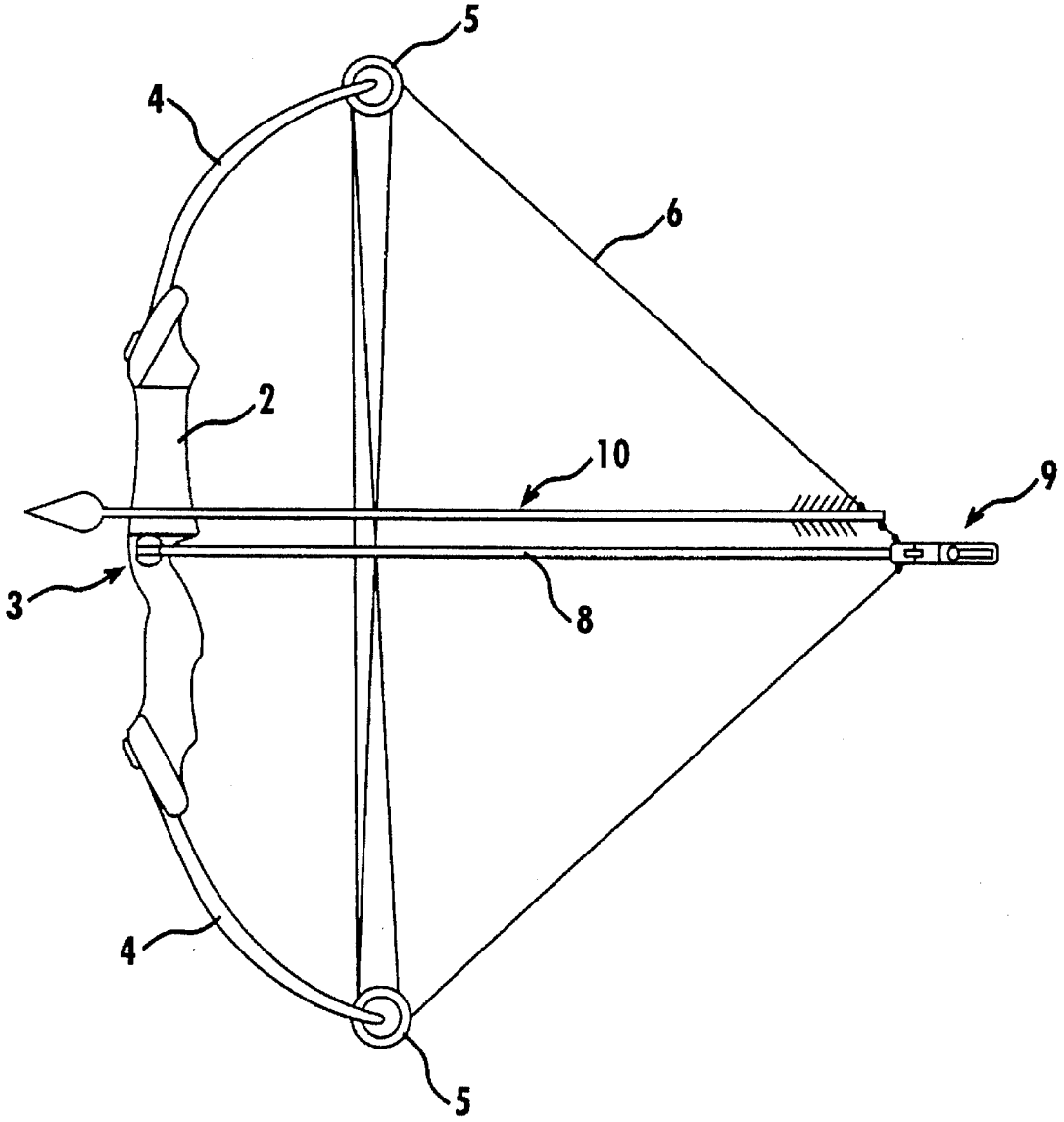
FIG. 11 is a side elevational view of the bow shown in FIG. 6 illustrating the tensioning device in the operative position.

As will be seen in FIGS. 6, 10, and 11, the rod 8 is attached to the bow 1 in the same manner as described hereinabove; namely, the bowstring 6 is latched to the trigger mechanism 9 which is pulled rearwardly. The distal end portion of the rod 8 slides along the fitting recess 11*b* until the end thereof reaches the entrance 11*c*, whereupon the end of the rod is allowed to drop into the blind bore 11*d*.

Figure 12:
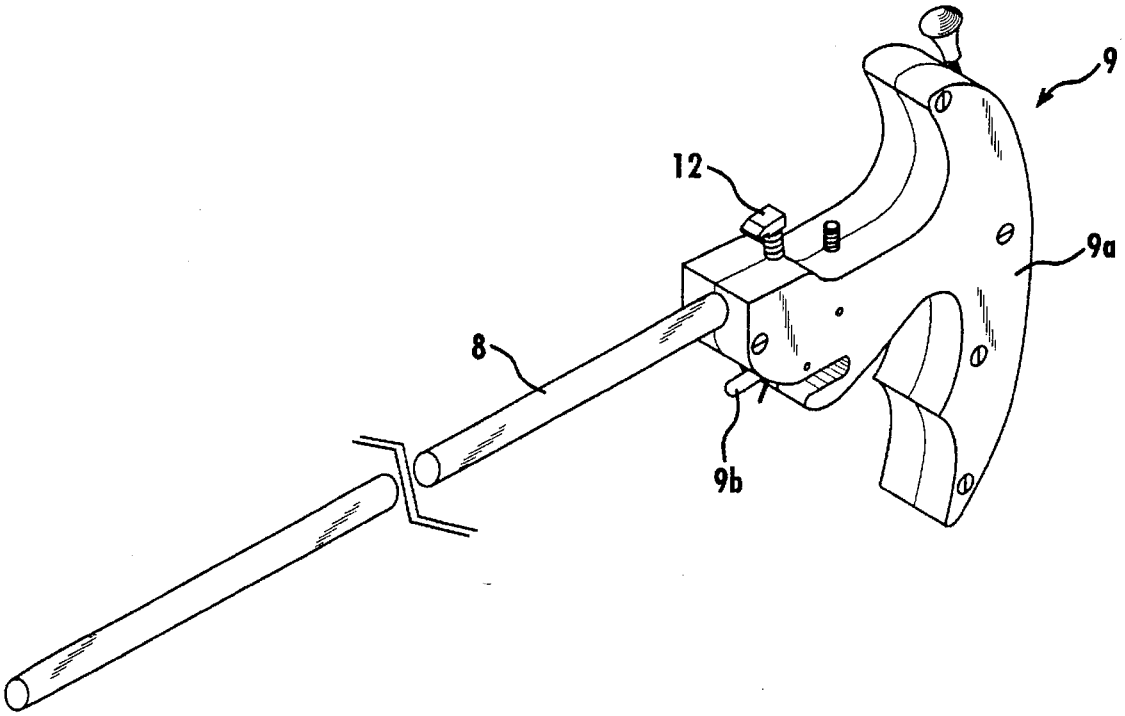
FIG. 12 is a perspective view of one embodiment of the tensioning device and its associated trigger mechanisms to be employed on the bow of FIG. 6.
Figure 13:
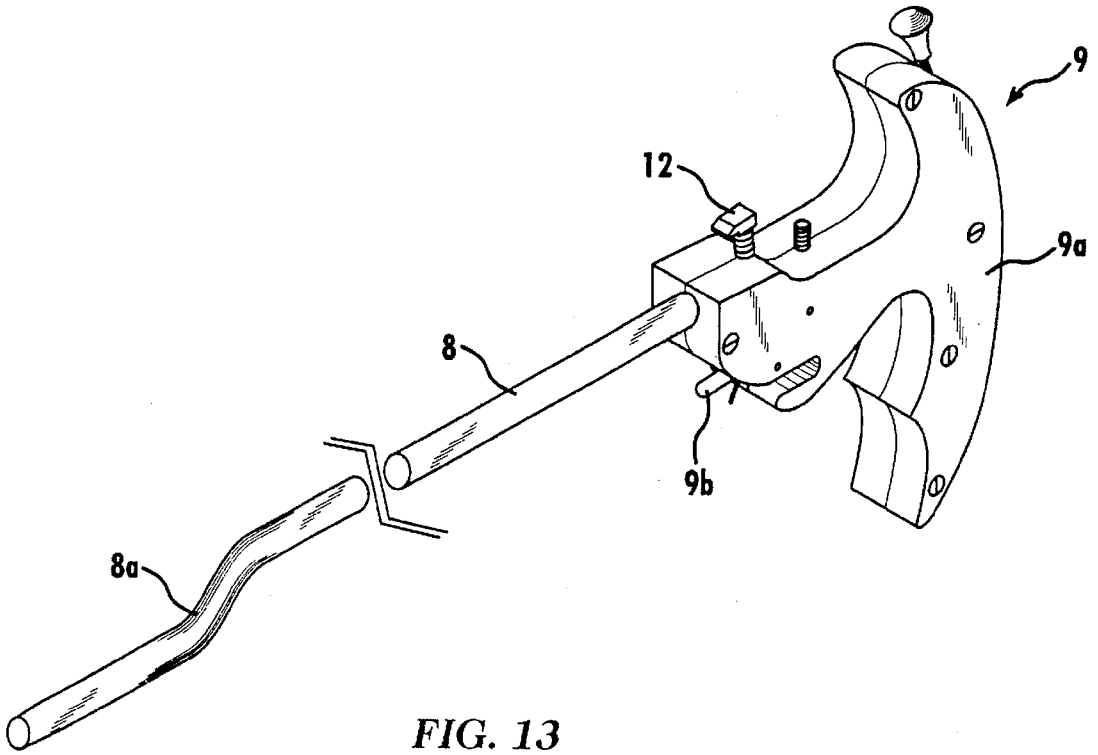
FIG. 13 is a perspective view of another embodiment of the tensioning device and its associated trigger mechanism to be employed on the bow of FIG. 3.
Figure 14:
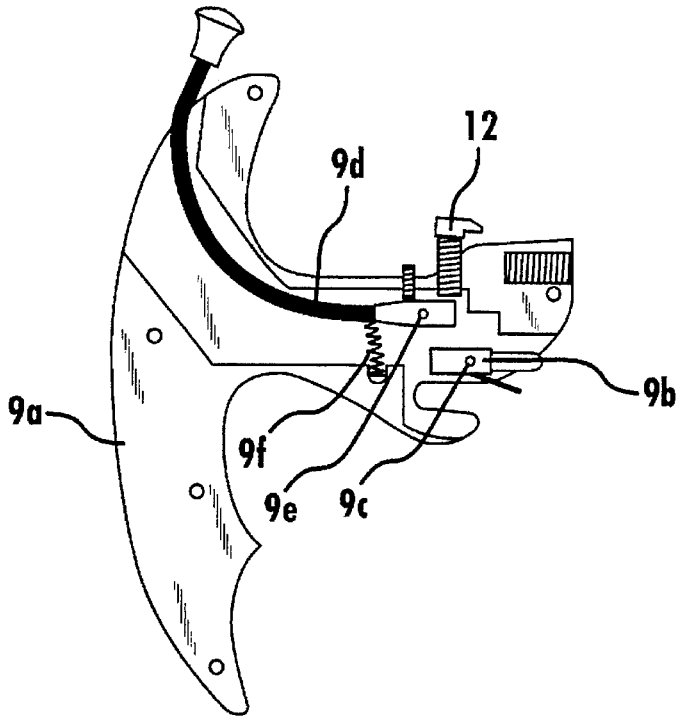
FIG. 14 is a side elevational view illustrating the details of the trigger mechanism.
Figure 15:
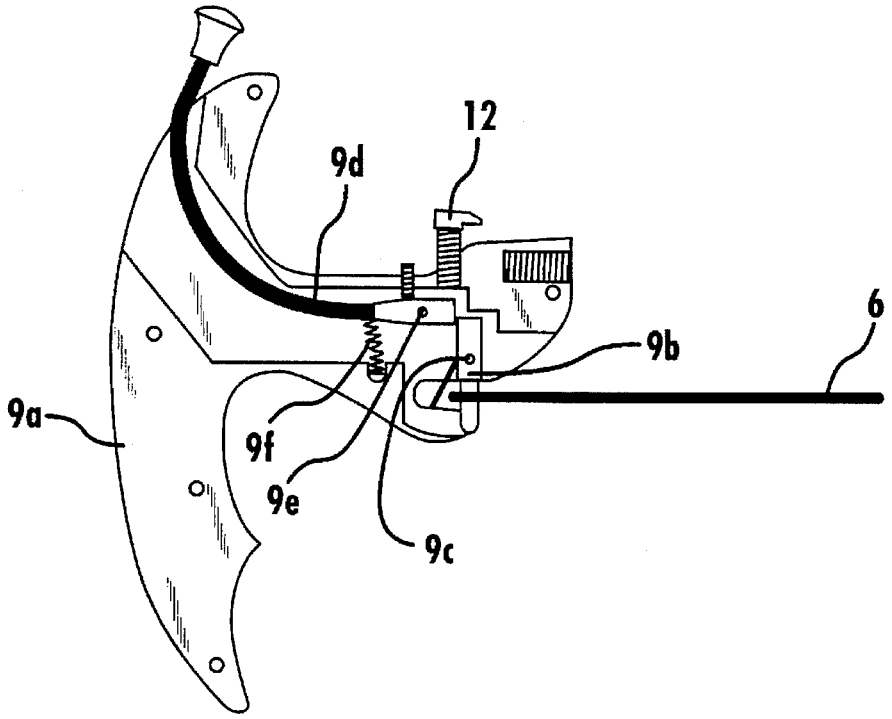
FIG. 15 is a side elevational view illustrating the trigger mechanism in the locked position.

Referring to FIGS. 12 to 15, the straight rod 8, shown in FIG. 12, will be employed when the bow 1 is provided with the fitting 11; and the rod 8, shown in FIG. 13, having an offset portion 8*a* at the distal end thereof will be employed when the recessed blind hole 7 is drilled into the bow handle 2 to thereby prevent the rod from interfering with the arrow 10. The trigger mechanism 9 comprises a housing 9*a* threaded onto the proximate end of the rod 8 and contains a latch 9*b* pivotally connected to the housing 9*a* as at 9*c*. A trip lever 9*d* is also pivotally connected to the housing 9*a* as at 9*e*. A compression spring 9*f* is mounted between the housing 9*a* and trip lever 9*d* for biasing the trip lever in a clockwise direction. When cocking the trigger mechanism, the bowstring 6 is connected to the latch 9*b* as shown in FIG. 15. The trip lever 9*d* pivots in a clockwise direction so that the end thereof abuts the latch 9*b*. When the free end of the trip lever 9*d* is pushed downwardly causing the trip lever to pivot in a counterclockwise direction, the latch 9*b* as associated bowstring 6 are released. The trigger mechanism described thus far is a conventional trigger mechanism employed in bow stabilizing bars; however, the trigger mechanism 9 provided with the tension rod 8 of the present invention has been improved by providing the trigger mechanism 9 with a safety catch 12 comprising a bolt 12*a* threadably mounted in the trigger housing 9*a* and adapted to engage the end of the trip lever 9*d* while it engages the latch 9*b*. By this construction and arrangement, the trip lever 9*a* will be prevented from pivoting in a counterclockwise direction to thereby prevent release of the latch 9*b*. By turning the bolt 12*a* outwardly from the housing 9*a*, the trip lever will be released.

From the above description, it will be readily appreciated by those skilled in the art that the tensioning device of the present invention is an improvement over heretofore employed stabilizing bars fixedly mounted to the bow, since the tensioning device of the present invention is freely mounted on the bow and releasable therefrom for use on another bow or for storage. The safety catch on the trigger mechanism is also an improvement on the conventional trigger mechanisms employed in the fixed stabilizing bars.

It is to be understood that the form of the invention herewith shown and described is to be taken as a preferred example of the same, and that various changes in the shape, size, and arrangement of parts may be resorted to, without departing from, the spirit of the invention or scope of the subjoined claims.

I claim:

1. A tensioning device for an archery bow having a handle and a bowstring comprising a continuous rod, said rod having a main body portion, one end of said continuous rod being integral with said main body portion, a blind bore on the bow handle, said one end of said rod being freely insertable in and removable from said blind bore, and a trigger mechanism mounted on the other end of the main body portion of said rod for releasably holding the bowstring in a fully drawn position, whereby after the bowstring has been released, the tensioning device is readily removable from the archery bow handle for storage.

2. A tensioning device according to claim 1, wherein the blind bore is provided by a fitting detachably connected to said handle, and a hole drilled into said fitting.

3. A tensioning device according to claim 1, wherein the trigger mechanism comprises a housing secured to said other end of said rod, a latch pivotally mounted in said housing for holding the bowstring, a trip lever pivotally mounted in said housing, one end of said trip lever adapted to engage said latch for holding the latch in a cocked position, a spring mounted between said housing and said trip lever for biasing said trip lever in a direction for holding the latch, and a safety catch mounted on said housing adapted to engage said trip lever to prevent the inadvertent release of the latch from the cocked position.

4. A tensioning device for an archery bow having a handle and a bowstring comprising a rod, a hole drilled into the bow handle forming a blind bore on the bow handle, one end of said rod being freely received in and releasable from said blind bore, and a trigger mechanism mounted on the other end of said rod for releasably holding the bowstring in a fully drawn position.

5. A tensioning device according to claim 4, wherein a recess is provided in the bow handle extending parallel to the longitudinal axis of said blind bore, said recess communicating with the entrance to said bore, to thereby facilitate the insertion of said one end of the rod into said bore.

6. A tensioning device for an archery bow having a handle and a bowstring comprising a rod, a fitting detachably connected to said handle, a hole drilled into said fitting forming a blind bore on the bow handle, one end of said rod being freely received in and releasable from said blind bore, a recess provided in the fitting extending parallel to the longitudinal axis of said blind bore, said recess communicating with the entrance to said bore, to thereby facilitate the insertion of said one end of the rod into said bore, and a trigger mechanism mounted on the other end of said rod for releasably holding the bowstring in a fully drawn position.

7. A tensioning device for an archery bow having a handle and a bowstring comprising a rod, a blind bore on the bow handle, one end of said rod being freely received in and releasable from said blind bore, and a trigger mechanism mounted on the other end of said rod for releasably holding the bowstring in a fully drawn position, said trigger mechanism comprising a housing secured to said other end of said rod, a latch pivotally mounted in said housing for holding the bowstring, a trip lever pivotally mounted in said housing, one end of said trip lever adapted to engage said latch for holding the latch in a cocked position, a spring mounted between said housing and said trip lever for biasing said trip lever in a direction for holding the latch, and a bolt threadably mounted on and extending into said housing, an end of said bolt adapted to engage said trip lever to thereby provide a safety catch to prevent the inadvertent release of the latch from the cocked position.

* * * * *